US006191688B1

(12) United States Patent
Sprouse

(10) Patent No.: US 6,191,688 B1
(45) Date of Patent: Feb. 20, 2001

(54) POWER-ON MASK DETECTION METHOD FOR MOTION DETECTORS

(75) Inventor: William T. Sprouse, Carmichael, CA (US)

(73) Assignee: Honeywell International, Inc., Morristown, NJ (US)

( * ) Notice: Under 35 U.S.C. 154(b), the term of this patent shall be extended for 0 days.

(21) Appl. No.: 09/273,579

(22) Filed: Mar. 22, 1999

(51) Int. Cl.[7] ..... G08B 13/24; G08B 13/191

(52) U.S. Cl. ..... 340/506; 340/522; 340/552; 340/554; 340/567

(58) Field of Search ..... 340/554, 552, 340/567, 522, 506

(56) References Cited

U.S. PATENT DOCUMENTS 4,242,669 * 12/1980 Crick ..... 340/567
5,499,016 * 3/1996 Pantus ..... 340/506
5,581,237 * 12/1996 DiPoala ..... 340/554
5,796,353 8/1998 Whitehead .

FOREIGN PATENT DOCUMENTS 2 308 482 6/1997 (GB) .

* cited by examiner

*Primary Examiner*—Glen Swann
(74) *Attorney, Agent, or Firm*—John P. O'Banion

(57) ABSTRACT

A method for determining if a motion detector is in a masked condition at the time power is applied to the detector. When power is first applied to the motion detector it enters a mask detection state which runs concurrently with activity and alarm detection routines. Any infrared motion that is detected after the detector has warmed up and stabilized will terminate the mask detection state. If a predetermined amount of microwave Doppler sensor activity is detected within the field of view without detection of infrared activity, a mask condition is declared.

31 Claims, 3 Drawing Sheets

POWER-ON MASK DETECTION METHOD FOR MOTION DETECTORS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to detecting attempts to bypass motion detectors, and more particularly to detecting, at power up of a motion detector, whether the motion detector has been masked.

2. Description of the Background Art

Motion detectors are widely used in alarm systems. State of the art motion detectors typically employ dual sensing technology, such as a microwave Doppler sensor combined with a passive infrared sensor (PIR), coupled with processing software. In most instances, the PIR sensor is the primary sensor and the microwave sensor is used as a secondary sensor to confirm a detection event from the PIR sensor. While the technology is reliable for detecting alarm conditions based on various sensed conditions, it is still possible to defeat a dual sensor motion detector by "masking" the PIR sensor. It is generally understood in the art that the term "masking" refers to placing a stationary object in front of a sensor, covering the sensor with a substance such as tape or paint, or the like. Even placement of a plate of glass or spraying clear varnish or hair spray over an infrared sensor window can be an effective mask. Most often, the PIR sensor is the target of masking since infrared signals are line of sight whereas microwave signals penetrate and bounce off of objects.

Understandably, mask detection is important if high levels of security are to be maintained at all times and various approaches to mask detection have thus been developed. The simplest is to monitor PIR activity and declare a mask condition if loss of activity occurs for a predetermined period of time, although this method is prone to false mask detects since an empty room will cause a mask condition to be indicated. Another approach is to detect a mask condition during the actual act of masking. In dual sensor detectors employing a microwave Doppler sensor, high level microwave signals are generated when a person or moving object comes into close proximity of the sensor. Therefore, items can be readily detected by a microwave Doppler sensor when they are moving into a position that will block the sensor. Unfortunately, however, once moved into position, a stationary object essentially becomes invisible to a microwave Doppler detector. Another approach is to use a near-infrared emitter/detector pair which looks for a reflected beam. A high reflected signal level would indicate a mask condition because of an object being placed in close proximity. However, this approach is costly and has a relatively high power consumption level.

Therefore, the most reliable approach to mask detection without incurring additional costs in price or power is to use the microwave Doppler sensor to detect close-up events; that is, movement to within approximately eighteen inches of the microwave Doppler sensor. Upon detection of the close-up event, a PIR detection window is opened. If PIR activity is detected during this window, then the mask detection routine ends. Otherwise, if no PIR activity occurs during that time period, a mask condition is declared.

A serious threat to security still exists, however, when using microwave-based mask detection, since this technology is dependent upon seeing the actual act of masking. Therefore, such technology cannot detect a mask if power is removed from the detector, such as, if a detector loses power while a sensor is masked, or the system is powered down during the daytime, or someone masks the sensor during a power outage. In any of those cases, since the masking has already occurred, the sensor will not give an indication that masking has taken place when it is powered up again. Therefore, a need exists for a system and method for detecting that a sensor has been masked without causing the sensor to declare a false masking condition when power loss occurs in an empty building. The present invention satisfies that need, as well as others, and overcomes the deficiencies found in conventional technology.

BRIEF SUMMARY OF THE INVENTION

The present invention pertains to determining if a motion detector is in a masked condition at the time power is applied to the detector. More particularly, the invention detects a situation where a person disconnects power to the detector by, for example, shutting down the power at the electrical panel, then masks the detector, and finally reapplies power.

By way of example, and not of limitation, to detect a mask condition in accordance with the present invention the detector is placed into a mask detection state when power is applied. Any infrared motion that is detected after the detector has warmed up and stabilized will terminate the mask detection state. However, if a predetermined amount of microwave sensor activity is detected within the field of view without detection of infrared activity, a mask condition is declared. This method of detecting a mask condition is based on the assumption that a large amount of microwave activity should be accompanied by at least a small amount of infrared activity if the infrared sensor has not been masked. The amount of microwave activity that required to trigger mask detection can be varied based on individual detector characteristics, but needs only be sufficiently large to avoid false mask detection resulting from microwave activity generated from radio transmitters, cellular telephones and other interfering sources.

An object of the invention is to detect attempts to bypass a motion detector.

Another object of the invention is to provide for reliable mask detection with virtually no additional component cost and virtually no additional power consumption as compared to using a near-infrared emitter/detector pair.

Another object of the invention is to determine if the infrared sensor in a motion detector has been masked.

Another object of the invention is to detect mask conditions in a motion detector after power up.

Another object of the invention is to detect masking of a motion detector occurring during a power outage.

Another object of the invention is to enable mask detection in a motion detector for a predetermined period after the motion detector is first powered on.

Another object of the invention is to detect masking of an infrared sensor in a motion detector using a microwave Doppler sensor as a trigger device.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
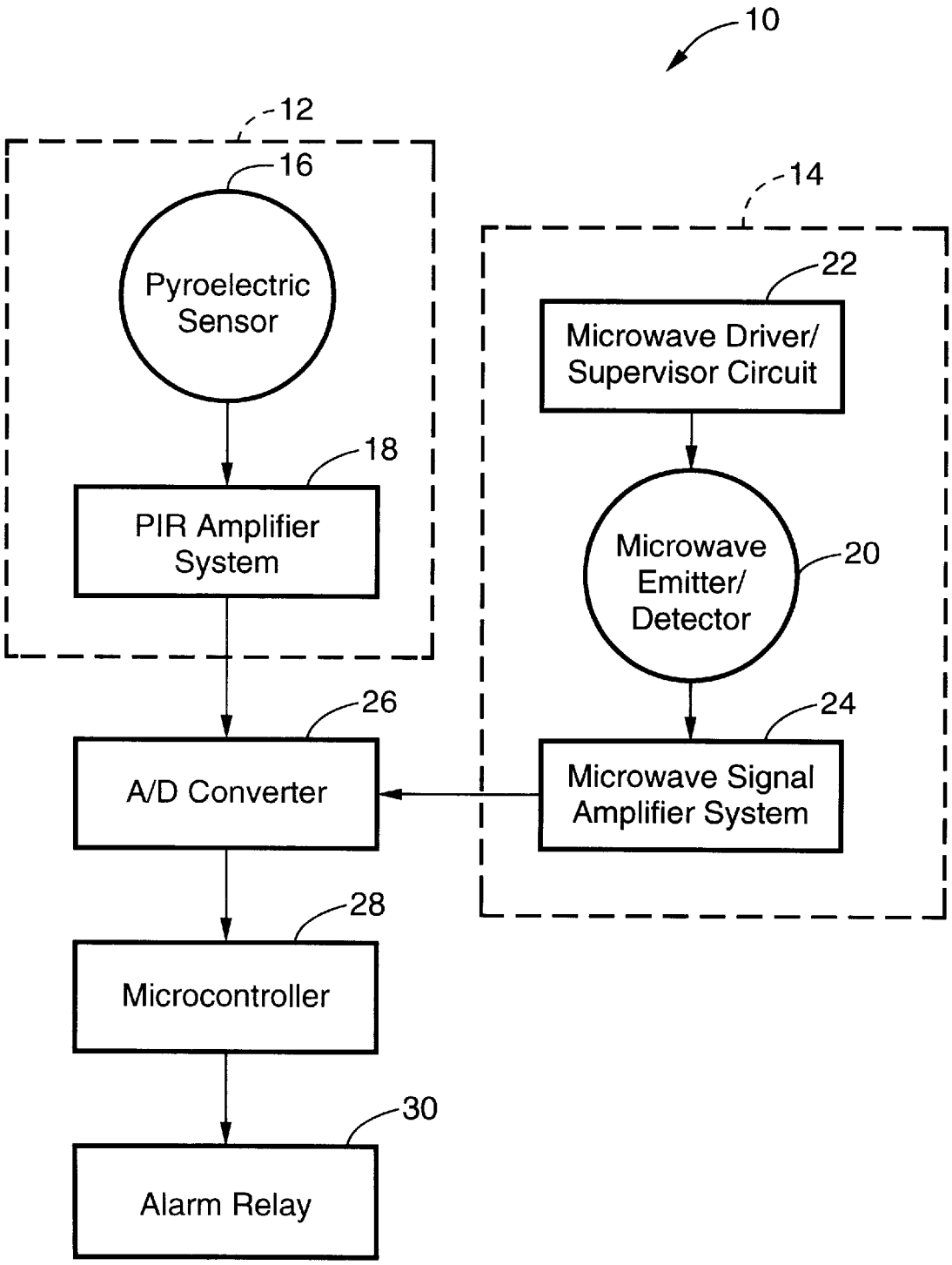
FIG. 1 is a functional block diagram of a dual-channel motion detector.

Referring first to FIG. 1, a functional block diagram of a dual sensor motion detector 10 is shown. Detector 10 includes an infrared channel 12 and a microwave channel 14, both of which output analog signals. The infrared channel typically comprises a pyroelectric sensor 16 and an amplifier system 18, while the microwave channel typically comprises a microwave emitter/detector as a Doppler sensor 20, a driver/supervisor circuit 22, and an amplifier system 24. The analog signals from both channels are converted to a digital form by an analog to digital converter (A/D) 26. A microcontroller 28 processes those signals and detects whether an alarm condition exists, and provides an output to an alarm relay 30. Microcontroller 28 typically includes one or more types of memory, such as read only memory or random access memory, for storing processing software and data, and can include A/D converter 26. Those skilled in the art will appreciate that other devices and subsystems could be included, and that the devices and subsystems shown may be interconnected in different ways than shown in FIG. 1.

It will be appreciated from the description that follows, that the invention can be implemented in software and/or firmware associated with a detector of the foregoing configuration or any other conventional detector having both infrared and microwave channels. Detector 10 is intended only to be an example of a conventional detector, and the present invention should not be considered as applying only to the detector shown in this example.

In general terms, the method of detecting a mask condition is based on the assumption that a large amount of microwave activity should be accompanied by at least a small amount of infrared activity if the infrared sensor has not been masked. It then follows that a predetermined amount of microwave activity without any infrared activity is indicative of a mask condition. It further follows that an unmasked sensor powered up in an empty room will not declare a mask condition since there will not be sufficient microwave activity to indicate a mask condition. And, while a masked sensor powered up in an empty room will also not declare a mask condition in the absence of microwave activity, if an intruder then enters the room, the detector would then declare a mask condition upon seeing the microwave activity generated. Alternatively, if the occupants return to the building after the sensor has been masked, their activity will cause the mask to be detected. Thus, the invention provides a reliable indication that something is wrong in the building without being subject to false mask conditions being declared.

Figure 2:
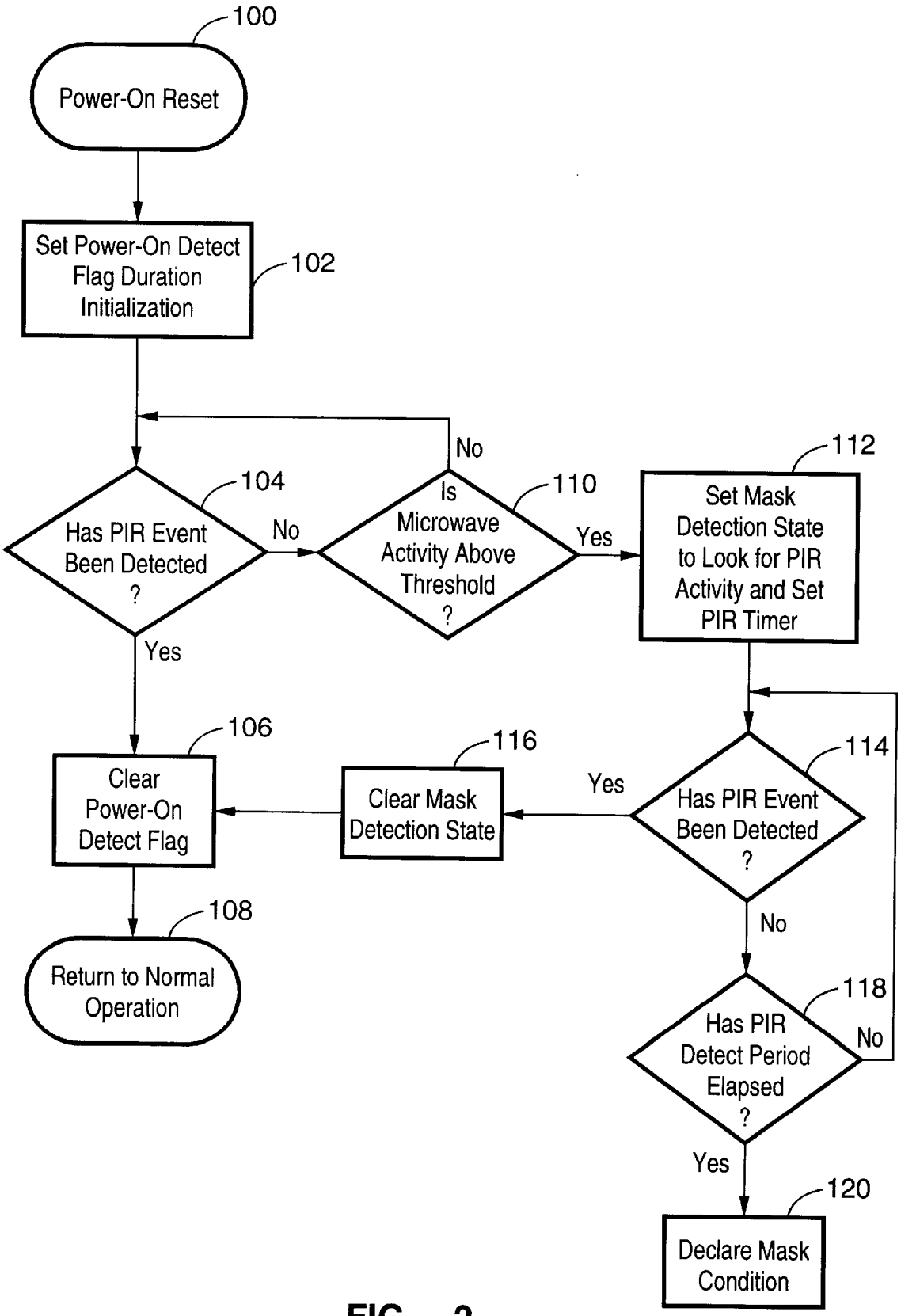
FIG. 2 is a flow chart showing a power-on mask detection method according to the invention for use with the motion detector shown in FIG. 1.

Referring now to FIG. 2, the steps of detecting a mask condition in accordance with the invention are shown. This method is preferably carried out by programming contained within microcontroller 28, but could be carried out by programming contained within a separate microcontroller. In addition, execution of this programming is preferably concurrent with normal activity and detection routines in the motion detector.

At step 100, the invention detects a power-on reset signal that is received by microcontroller 28. A conventional power-on detect circuit such as that shown in FIG. 3 is used to provide a power-on reset signal to the reset input found on most microcontrollers.

Figure 3:
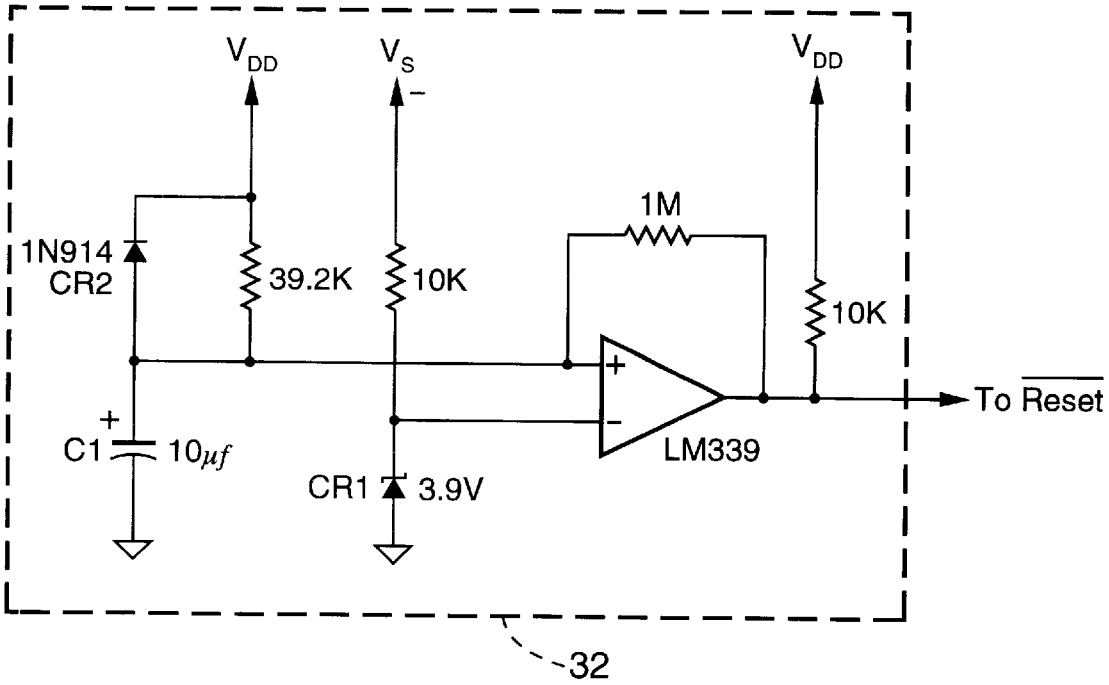
FIG. 3 is a schematic of an embodiment of a power-on reset circuit for the motion detector of FIG. 1.

In the circuit shown in FIG. 3, Vs is the incoming power line to the motion detector, after transient suppression and a reverse polarity protection diode (not shown). Vdd is the regulated power supply voltage operating the microcontroller, and charges the capacitor C1. Initially with capacitor C1 starting out discharged, the reset line goes low and resets the microcontroller. When the charge on capacitor C1 goes above the 3.9 volt threshold of the zener diode CR1, the reset output goes high and allows the microcontroller to begin operation. If Vdd drops during operation, diode CR2 allows for quick discharging of C1 so that brown-outs can be quickly detected.

Next, at step 102, the system waits for approximately sixty seconds to allow the amplifiers in the detector to stabilize. In addition, a power-on detect flag is set during this initialization period. This flag is used to the indicate that we are in a power-on mask detection state, so that the power-on mask detect routine is executed every time the alarm processing code runs through a new cycle. In other words, the power-on mask detect routine runs in parallel with the alarm processing code.

After initialization, at step 104 the infrared sensor is tested to determine if any infrared activity has been detected. If so, the power-on detect flag is reset at step 106 and the system returns to normal operation at step 108. Since infrared activity was detected, there is no need to continue to evaluate whether a power-on mask condition exists. By clearing the power-on detect flag, the power-on mask detect routine will not execute the next time the alarm processing code runs through a new cycle.

If infrared activity was not detected at step 104, then at step 110 the microwave Doppler sensor is tested for a predetermined amount of activity. Using the detector configuration shown in FIG. 1, the threshold is approximately eight events in an approximately three-second moving window, although the window duration and threshold amount of microwave activity required to occur within that window can be varied based on individual detector characteristics. The threshold should, however, be sufficiently high as to avoid false mask detection resulting from microwave activity generated from radio transmitters, cellular telephones, movement in an adjacent room, and other interfering sources. In other words, the goal is to choose a threshold that detects that there is actually motion in the room being protected.

If the threshold amount of microwave activity is detected, at step 112 an infrared detection timing window is opened. Preferably this window is approximately fifteen seconds. A shorter widow results in faster mask detection, while a longer window results in higher false mask immunity. If infrared activity is detected within that window at step 114, the mask detection state is cleared at step 116, the power-on detect flag is cleared at step 106, and the system returns to normal operation at step 108. Alternatively, if no infrared activity was detected at step 114, the elapsed time is tested at step 118. If the window time period has not been exceeded, the infrared sensor continues to be tested and, if no infrared activity is detected when the window period has elapsed, a mask detect condition is declared at step 120.

It will be understood that the operable software or code for implementing the present invention may be written in various programming languages for various platforms using conventional programming techniques. Accordingly, the details of the operations code are not presented herein.

Accordingly, it will be seen that this invention provides for reliable mask detection initiated by a power-on event. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A power-on mask detection method for a motion detector having an infrared sensor and a microwave Doppler sensor, comprising the steps of:

(a) initiating a mask detection process upon detecting that power has been applied to said motion detector;

(b) terminating said mask detection process upon detection of a sensed infrared signal;

(c) initiating a mask detection timing window if detected microwave signals exceed a threshold prior to detection of an infrared signal; and (d) declaring a mask condition if an infrared signal is not detected during said mask detection timing window.

2. A power-on mask detection method as recited in claim 1, further comprising the step of terminating said mask detection process after declaring a mask condition.

3. A power-on mask detection method as recited in claim 1, wherein said mask detection timing window has a duration of approximately fifteen seconds.

4. A power-on mask detection method as recited in claim 1, wherein said threshold comprises approximately eight sensed events during a time period of approximately three seconds.

5. A power-on mask detection method for a motion detector having an infrared sensor and a microwave Doppler sensor, comprising the steps of:

(a) initiating a mask detection process upon detecting that power has been applied to said motion detector;

(b) monitoring signals from said infrared sensor;

(c) terminating said mask detection process if an infrared signal is detected;

(d) monitoring signals from said microwave Doppler sensor;

(e) initiating a mask detection timing window if microwave signals are detected at a level exceeding a threshold prior to detection of an infrared signal; and (f) declaring a mask condition if an infrared signal is not detected during said mask detection timing window.

6. A power-on mask detection method as recited in claim 5, further comprising the step of terminating said mask detection process after declaring a mask condition.

7. A power-on mask detection method as recited in claim 5, wherein said mask detection timing window has a duration of approximately fifteen seconds.

8. A power-on mask detection method as recited in claim 5, wherein said threshold comprises approximately eight sensed events during a time period of approximately three seconds.

9. A power-on method for detecting masking in a motion detector having an infrared sensor and a microwave Doppler sensor, comprising the steps of:

(a) detecting a power-on reset signal generated from said motion detector;

(b) monitoring signals from said infrared sensor and said microwave Doppler sensor upon detection of said power-on reset signal;

(c) initiating a mask detection timing window if microwave sensor activity above a threshold is detected prior to detection of an infrared signal;

(d) declaring a mask condition if an infrared signal is not detected within said mask detection timing window; and (e) resuming normal operation upon detection of a sensed infrared signal.

10. A power-on mask detection method as recited in claim 9, wherein said mask detection timing window has a duration of approximately fifteen seconds.

11. A power-on mask detection method as recited in claim 9, wherein said threshold comprises approximately eight sensed events during a time period of approximately three seconds.

12. A power-on method for detecting masking in a motion detector having an infrared sensor and a microwave Doppler sensor, comprising the steps of:

(a) detecting a power-on reset signal generated from said motion detector;

(b) monitoring signals from said infrared sensor and said microwave Doppler sensor upon detection of said power-on reset signal;

(c) resuming normal operation upon detection of an infrared signal;

(d) initiating a mask detection timing window if microwave signals above a threshold are detected prior to detection of an infrared signal;

(e) declaring a mask condition if an infrared signal is not detected within said mask detection timing window; and (f) resuming normal operation upon detection of a sensed infrared signal within said mask detection timing window.

13. A power-on mask detection method as recited in claim 12, wherein said mask detection timing window has a duration of approximately fifteen seconds.

14. A power-on mask detection method as recited in claim 12, wherein said threshold comprises approximately eight sensed events during a time period of approximately three seconds.

15. A power-on method for detecting masking in a motion detector having an infrared sensor and a microwave Doppler sensor, comprising the steps of:

(a) detecting a power-on reset signal generated from said motion detector;

(b) monitoring signals from said infrared sensor and said microwave Doppler sensor upon detection of said power-on reset signal;

(c) resuming normal operation upon detection of an infrared signal;

(d) initiating a mask detection timing window having a duration of approximately fifteen seconds if, prior to detection of an infrared signal, approximately eight events are detected by said microwave Doppler sensor within a moving time window having a duration of approximately three seconds;

(e) declaring a mask condition if an infrared signal is not detected within said mask detection timing window; and (f) resuming normal operation upon detection of a sensed infrared signal within said mask detection timing window.

16. A mask detecting motion detector, comprising:

(a) an infrared sensor;

(b) a microwave Doppler sensor;

(c) a microcontroller operatively coupled to said infrared and microwave Doppler sensors; and (d) programming associated with said programmable data processor for carrying out the operations of:

(i) initiating a mask detection process upon detecting that power has been applied to said motion detector;

(ii) terminating said mask detection process upon detection of a sensed infrared signal;

(iii) initiating a mask detection timing window if detected microwave signals exceed a threshold prior to detection of an infrared signal; and (iv) declaring a mask condition if an infrared signal is not detected during said mask detection timing window.

17. A motion detector as recited in claim 16, wherein said programming further carries out the operation of terminating said mask detection process after declaring a mask condition.

18. A motion detector as recited in claim 17, wherein said threshold comprises approximately eight sensed events during a time period of approximately three seconds.

19. A motion detector as recited in claim 16, wherein said mask detection timing window has a duration of approximately fifteen seconds.

20. A mask detecting motion detector, comprising:

(a) an infrared sensor;

(b) a microwave Doppler sensor;

(c) a microcontroller operatively coupled to said infrared and microwave Doppler sensors; and (d) programming associated with said microcontroller for carrying out the operations of:

(i) initiating a mask detection process upon detecting that power has been applied to said motion detector;

(ii) monitoring signals from said infrared sensor;

(iii) terminating said mask detection process if an infrared signal is detected;

(iv) monitoring signals from said microwave Doppler sensor;

(v) initiating a mask detection timing window if microwave signals are detected at a level exceeding a threshold prior to detection of an infrared signal; and (vi) declaring a mask condition if an infrared signal is not detected during said mask detection timing window.

21. A motion detector as recited in claim 20, wherein said programming further carries out the operation of terminating said mask detection process after declaring a mask condition.

22. A motion detector as recited in claim 20, wherein said mask detection timing window has a duration of approximately fifteen seconds.

23. A motion detector as recited in claim 20, wherein said threshold comprises approximately eight sensed events during a time period of approximately three seconds.

24. A mask detecting motion detector, comprising:

(a) an infrared sensor;

(b) a microwave Doppler sensor;

(c) a microcontroller operatively coupled to said infrared and microwave Doppler sensors; and (d) programming associated with said microcontroller for carrying out the operations of:

(i) detecting a power-on reset signal generated from said motion detector;

(ii) monitoring signals from said infrared sensor and said microwave Doppler sensor upon detection of said power-on reset signal;

(iii) initiating a mask detection timing window if microwave signals above a threshold are detected prior to detection of an infrared signal;

(iv) declaring a mask condition if an infrared signal is not detected within said mask detection timing window; and (v) resuming normal operation upon detection of a sensed infrared signal.

25. A motion detector as recited in claim 24, wherein said mask detection timing window has a duration of approximately fifteen seconds.

26. A motion detector as recited in claim 24, wherein said threshold comprises approximately eight sensed events during a time period of approximately three seconds.

27. A mask detecting motion detector, comprising:

(a) an infrared sensor;

(b) a microwave Doppler sensor;

(c) a microcontroller operatively coupled to said infrared and microwave Doppler sensors; and (d) programming associated with said microcontroller for carrying out the operations of:

(i) detecting a power-on reset signal generated from said motion detector;

(ii) monitoring signals from said infrared sensor and said microwave Doppler sensor upon detection of said power-on reset signal;

(iii) resuming normal operation upon detection of an infrared signal;

(iv) initiating a mask detection timing window if microwave signals above a threshold are detected prior to detection of an infrared signal;

(v) declaring a mask condition if an infrared signal is not detected within said mask detection timing window; and (vi) resuming normal operation upon detection of a sensed infrared signal within said mask detection timing window.

28. A motion detector as recited in claim 27, wherein said programming further carries out the operation of terminating said mask detection process after declaring a mask condition.

29. A motion detector as recited in claim 27, wherein said mask detection timing window has a duration of approximately fifteen seconds.

30. A motion detector as recited in claim 27, wherein said threshold comprises approximately eight sensed events during a time period of approximately three seconds.

31. A mask detecting motion detector, comprising:

(a) an infrared sensor;

(b) a microwave Doppler sensor;

(c) a microcontroller operatively coupled to said infrared and microwave Doppler sensors; and (d) programming associated with said microcontroller for carrying out the operations of:

(i) detecting a power-on reset signal generated from said motion detector;

(ii) monitoring signals from said infrared sensor and said microwave Doppler sensor upon detection of said power-on reset signal;

(iii) resuming normal operation upon detection of an infrared signal;

(iv) initiating a mask detection timing window having a duration of approximately fifteen seconds if, prior to detection of an infrared signal, approximately eight events are detected by said microwave Doppler sensor within a moving time window having a duration of approximately three seconds;

(v) declaring a mask condition if an infrared signal is not detected within said mask detection timing window; and (vi) resuming normal operation upon detection of a sensed infrared signal within said mask detection timing window.

* * * * *